US011022136B2

(12) United States Patent
Chen et al.

(10) Patent No.: US 11,022,136 B2
(45) Date of Patent: Jun. 1, 2021

(54) FAN AND MANUFACTURING METHOD THEREOF

(71) Applicant: DELTA ELECTRONICS, INC., Taoyuan (TW)

(72) Inventors: Chiu-Kung Chen, Taoyuan (TW); Chao-Wen Lu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 145 days.

(21) Appl. No.: 15/983,607

(22) Filed: May 18, 2018

(65) Prior Publication Data

US 2018/0266434 A1 Sep. 20, 2018

Related U.S. Application Data

(63) Continuation-in-part of application No. 13/224,323, filed on Sep. 1, 2011, now abandoned.

(30) Foreign Application Priority Data

Sep. 3, 2010 (TW) ..... 09912981

(51) Int. Cl.
*F04D 29/32* (2006.01)
*F04D 29/28* (2006.01)
(Continued)

(52) U.S. Cl.
CPC ..... *F04D 29/329* (2013.01); *F04D 17/16* (2013.01); *F04D 25/062* (2013.01);
(Continued)

(58) Field of Classification Search
CPC .... F04D 17/16; F04D 25/0613; F04D 25/062; F04D 25/08; F04D 29/056; F04D 29/181;
(Continued)

(56) References Cited

U.S. PATENT DOCUMENTS 5,105,645 A * 4/1992 Kobayashi ..... B21D 51/26 72/348
5,211,327 A * 5/1993 Clarke ..... B23K 10/02 228/174

(Continued)

FOREIGN PATENT DOCUMENTS

CN 1254977 A 5/2000
CN 1391325 A 1/2003

(Continued)

*Primary Examiner* — Patrick Hamo
*Assistant Examiner* — Joseph S. Herrmann
(74) *Attorney, Agent, or Firm* — Kirton McConkie; Evan R. Witt

(57) ABSTRACT

A fan includes a motor base, a bearing, an impeller, a stator and a magnetic element. The motor base has a bearing stand in a center portion thereof. The bearing is accommodated within the bearing stand. The impeller includes a metallic case, a hub, plural blades and a rotating shaft. The metallic case has a top wall and a sidewall. The hub is sheathed around the metallic case. The blades are disposed around an outer periphery of the hub. The rotating shaft is inserted into a central opening of the top wall and penetrated through the bearing stand, wherein no raised ring structure is formed in the top wall of the metallic case, and the rotating shaft and the metallic case are jointed together by a laser welding process. The magnetic element is disposed on an inner wall of the metallic case and aligned with the stator.

9 Claims, 6 Drawing Sheets

(51) Int. Cl.

| | |
|---|---|
| ***F04D 29/40*** | (2006.01) |
| ***F04D 25/06*** | (2006.01) |
| ***F04D 25/08*** | (2006.01) |
| ***F04D 29/056*** | (2006.01) |
| ***F04D 29/42*** | (2006.01) |
| ***F04D 17/16*** | (2006.01) |

(52) U.S. Cl.
CPC ..... *F04D 25/0613* (2013.01); *F04D 25/08* (2013.01); *F04D 29/056* (2013.01); *F04D 29/281* (2013.01); *F04D 29/403* (2013.01); *F04D 29/4226* (2013.01)

(58) Field of Classification Search
CPC .. F04D 29/329; F04D 29/403; F04D 29/4226; H02K 1/2786; H02K 9/06; H02K 17/14; H02K 21/22
See application file for complete search history.

(56) References Cited

U.S. PATENT DOCUMENTS

| | | | | |
|---|---|---|---|---|
| 5,744,882 | A * | 4/1998 | Teshima | G11B 17/038 310/67 R |
| 6,339,275 | B1 | 1/2002 | Katagiri | |
| 6,381,842 | B2 * | 5/2002 | Kato | B23K 15/04 29/888.022 |
| 6,781,266 | B2 * | 8/2004 | Le | F16C 33/107 310/90 |
| 7,474,032 | B2 * | 1/2009 | Horng | F04D 25/0653 310/156.32 |
| 7,671,498 | B2 | 3/2010 | Chen et al. | |
| 7,675,210 | B2 * | 3/2010 | Maekawa | H02K 7/086 310/67 R |
| 7,946,769 | B2 * | 5/2011 | Hamada | F16C 43/02 384/107 |
| 10,393,162 | B2 * | 8/2019 | Iwama | F16B 5/08 |
| 2006/0202577 | A1 | 9/2006 | Maekawa et al. | |
| 2007/0104593 | A1 | 5/2007 | Yamaguchi | |
| 2007/0128052 | A1 * | 6/2007 | Moriya | F04D 25/0613 417/354 |
| 2007/0188034 | A1 * | 8/2007 | Yoshida | F04D 29/063 310/90 |
| 2007/0212219 | A1 * | 9/2007 | Teshima | F04D 25/0613 415/206 |
| 2009/0001825 | A1 * | 1/2009 | Hanaoka | H02K 15/03 310/419 |
| 2010/0181875 | A1 * | 7/2010 | Tamaoka | G11B 19/2009 310/425 |

FOREIGN PATENT DOCUMENTS

| | | | |
|---|---|---|---|
| CN | 201228662 | Y | 4/2009 |
| JP | S62244587 | A | 10/1987 |
| JP | S63317269 | A | 12/1988 |
| JP | 2007300741 | A | 11/2007 |
| JP | 2007315400 | A | 12/2007 |
| JP | 2010025087 | A | 2/2010 |
| TW | M350746 | U | 2/2009 |
| TW | M376656 | U | 3/2010 |
| TW | I327457 | B | 7/2010 |

* cited by examiner

FAN AND MANUFACTURING METHOD THEREOF

CROSS-REFERENCE TO RELATED APPLICATION

This application is a continuation-in-part application of U.S. application Ser. No. 13/224,323 filed on Sep. 1, 2011, the entirety of which is hereby incorporated by reference.

FIELD OF THE INVENTION

The present invention relates to a fan, and more particularly to a slim-type fan. The present invention also relates to a method of manufacturing such a fan.

BACKGROUND OF THE INVENTION

With rapid development of high-tech industries, various electronic devices such as computer or servers become essential in our lives. As known, the heat-dissipating efficacy of the electronic device influences the operating stability and the use life of the overall system. For increasing the heat-dissipating efficacy and the operating stability of the electronic device, a fan is usually installed within the electronic device or installed in the ambient environment to cool the electronic device. Typically, a conventional fan comprises an impeller and a motor. FIG 1A is a schematic perspective view illustrating an impeller of a conventional fan. FIG. 1B is a schematic exploded view illustrating the impeller of FIG. 1A. FIG. 1C is a schematic cross-sectional view illustrating the impeller of FIG. 1A. Please refer to FIGS. 1A, 1B and 1C. The impeller 1 comprises a hub 10, plural blades 11, a metallic ring 12 and a rotating shaft 13. The blades 11 are disposed around the outer periphery of the hub 10. The blades 11 and the hub 10 are integrally formed by a plastic injection molding process. The metallic ring 12 is disposed on the inner peripheral of the hub 10. The rotating shaft 13 is protruded from a center portion of the hub 10.

For manufacturing the impeller 1, after the metallic ring 12 is placed within a plastic injection mold (not shown) and the rotating shaft 13 is inserted into the mold, the impeller 1 including the hub 10, the blades 11, the metallic ring 12 and the rotating shaft 13 is produced by the plastic injection molding process. For increasing the adhesion between the rotating shaft 13 and the hub 10, the thickness of the hub 10 should be greater than a minimum thickness. In addition, a raised ring structure 101 is vertically formed on the center portion of the inner surface of the hub 10 and extended along the direction of the rotating shaft 13. The rotating shaft 13 is inserted into the raised ring structure 101. Moreover, plural reinforcing ribs 102 are radially arranged around the raised ring structure 101. The rotating shaft 13 further has an embossed recess 131 corresponding to the raised ring structure 101 in order to further increase the adhesion between the rotating shaft 13 and the hub 10.

The conventional impeller, however, still has some drawbacks. For example, since the thickness of the hub 10 should be greater than a minimum thickness and the raised ring structure 101 and the reinforcing ribs 102 of the hub 10 are necessary, the process of producing the mold for the impeller is difficult. In addition, the overall height of the impeller is too high. Moreover, since the rotating shaft 13 further has an embossed recess 131 to increase the adhesion between the rotating shaft 13 and the hub 10, if a small-sized rotating shaft 13 is used to produce a slim impeller, it is difficult to produce the embossed recess 131.

Therefore, there is a need of providing a slim-type fan and a manufacturing method thereof in order to obviate the drawbacks encountered from the prior art.

SUMMARY OF THE INVENTION

It is an object of the present invention to provide a fan and a manufacturing method thereof so as to simplify the mold for the impeller, avoid the problem of abrading the rotating shaft and simply the process of producing the rotating shaft.

It is another object of the present invention to provide a fan and a manufacturing method thereof so as to reduce an overall thickness of the fan and achieve the slimness of the fan.

In accordance with an aspect of the present invention, there is provided a fan. The fan includes a motor base, a bearing, an impeller, a stator and a magnetic element. The motor base has a bearing stand in a center portion thereof. The bearing is accommodated within the bearing stand. The impeller includes a metallic case, a hub, plural blades and a rotating shaft. The metallic case has a top wall and a sidewall extended axially from an outer periphery of the top wall. The top wall has a central opening, and the depth of the central opening is equal to or less than the thickness of the top wall. The hub is sheathed around the metallic case. The blades are disposed around an outer periphery of the hub for driving axial airflow or radial airflow. The rotating shaft is inserted into the central opening and penetrated through the bearing stand. The rotating shaft is combined within the central opening by a laser welding process. The stator is disposed around an outer periphery of the bearing stand. The magnetic element is disposed on the metallic case and aligned with the stator.

In an embodiment, the thickness of the top wall of the metallic case is ranged from 0.1 mm-2.0 mm. No embossed recess is formed in the rotating shaft. The overall thickness of the fan is smaller than 10 mm.

In accordance with another aspect of the present invention, there is provided a fan. The fan includes a motor base, a bearing, an impeller, a stator and a magnetic element. The motor base has a bearing stand in a center portion thereof. The bearing is accommodated within the bearing stand. The impeller includes a metallic case, plural blades and a rotating shaft. The metallic case has a top wall and a sidewall extended axially from an outer periphery of the top wall. The blades are disposed around an outer periphery of the metallic case. The rotating shaft is protruded from a center portion of the top wall and penetrated through the bearing stand. In addition, no raised ring structure is formed in the top wall of the metallic case, and the rotating shaft and the metallic case are jointed together by a laser welding process. The stator is disposed around an outer periphery of the bearing stand. The magnetic element is disposed on an inner wall of the metallic case and aligned with the stator.

In an embodiment, the blades are made of metallic material. The blades are integrally formed with the metallic case.

In accordance with a further aspect of the present invention, there is provided a method for manufacturing a fan. The method comprises steps of: providing a metallic case having a top wall and a sidewall extended downwardly from an outer periphery of the top wall; combining a rotating shaft with the metallic case by a laser welding process, so that the rotating shaft is protruded from a center portion of the top wall of the metallic case; placing a combination of the rotating shaft and the metallic case within a mold, and producing a hub and plural blades by a plastic injection molding process, wherein the hub is sheathed around the metallic case, and the blades are disposed around an outer periphery of the hub; providing a motor base having a bearing stand in a center portion thereof, and accommodating a bearing within the bearing stand, and disposing a stator around an outer periphery of the bearing stand; and disposing a magnetic element on an inner wall of the metallic case, and penetrating the rotating shaft through the bearing such that the magnetic element is aligned with the stator.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
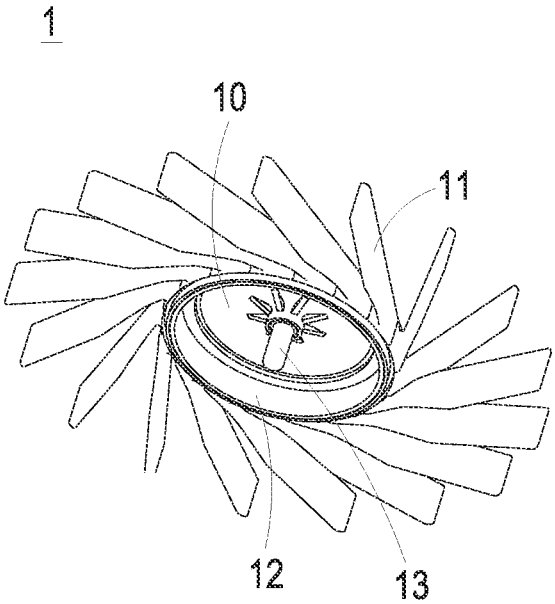
FIG. 1A PRIOR ART
FIG. 1A is a schematic perspective view illustrating an impeller of a conventional fan.
Figure 1B:
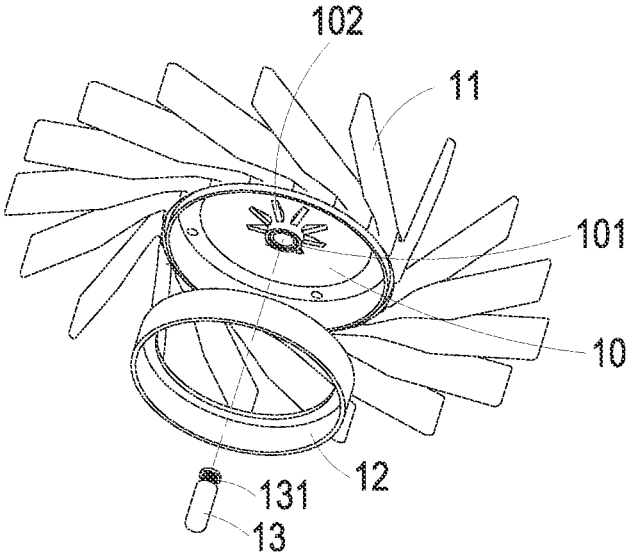
FIG. 1B PRIOR ART
FIG. 1B is a schematic exploded view illustrating the impeller of FIG. 1A.
Figure 1C:
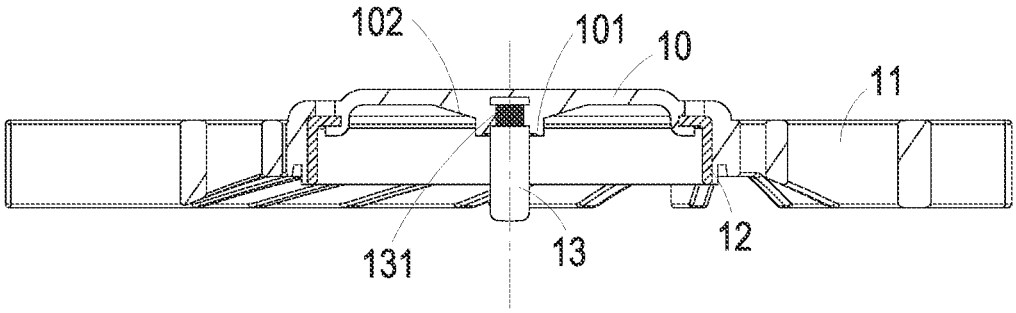
FIG. 1C PRIOR ART
FIG. 1C is a schematic cross-sectional view illustrating the impeller of FIG. 1A.
Figure 2A:
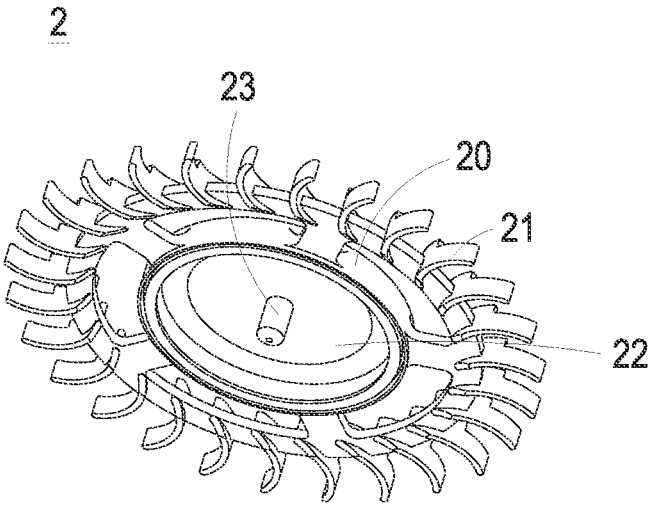
FIG. 2A is a schematic perspective view illustrating an impeller of a fan according to an embodiment of the present invention.
Figure 2B:
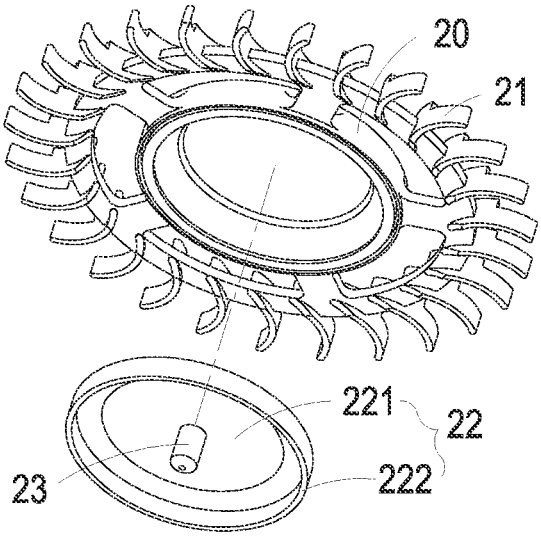
FIG. 2B is a schematic exploded view illustrating the impeller of FIG. 2A.
Figure 2C:
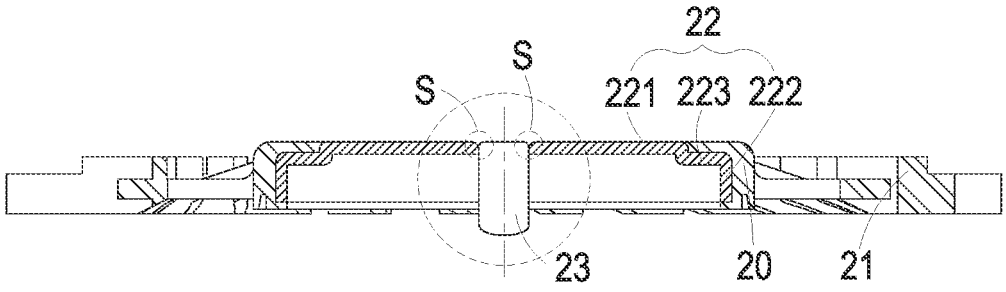
FIG. 2C is a schematic cross-sectional view illustrating the impeller of FIG. 2A.
Figure 2D:
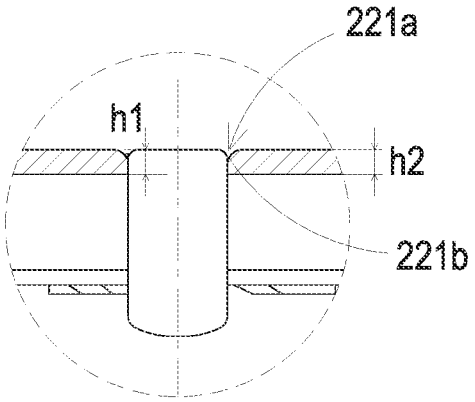
FIG. 2D is a partial enlargement schematic view of FIG. 2C.

FIG. 2A is a schematic perspective view illustrating an impeller of a fan according to an embodiment of the present invention. FIG. 2B is a schematic exploded view illustrating the impeller of FIG. 2A. FIG. 2C is a schematic cross-sectional view illustrating the impeller of FIG. 2A. FIG. 2D is a partial enlargement schematic view of FIG. 2C. Please refer to FIGS. 2A, 2B, 2C and 2D. The impeller 2 comprises a hub 20, plural blades 21, a metallic case 22 and a rotating shaft 23. The metallic case 22 is sheathed by the hub 20. The blades 21 are disposed around the outer periphery of the hub 20 for driving axial airflow or radial airflow. In addition, the blades 21 and the hub 20 are integrally formed by a plastic injection molding process.

The metallic case 22 has a top wall 221 and a sidewall 222. The sidewall 222 is axially or downwardly extended from the outer periphery of the top wall 221. As shown in FIG. 2C and FIG. 2D, the top wall 221 has a central opening 221*a* in its central portion, and the depth h1 of the central opening 221*a* is equal to or less than the thickness h2 of the top wall 221. The rotating shaft 23 is made of metallic material, and protruded from a center portion of the top wall 221. After the rotating shaft 23 is inserted into the central opening 221*a* of the top wall 221, the rotating shaft 23 is combined within the central opening 221*a* of the top wall 221 by a laser welding process, and a top surface 230 of the rotating shaft 23 and a top surface 2210 of the top wall 221 of the metallic case 22 are coplanar. In FIG. 2C, the welding region S is circled by a dashed line. During the laser welding process is performed, high power laser beams are projected on the metallic surface to melt the metallic surface. After the molten metal is cooled, the rotating shaft 23 and the metallic case 22 are jointed together. Since the laser welding process has small welding joints 221*b*, high precision and centralized energy, the laser welding process is able to form a secure welded structure through thin-walled parts. Since the laser welding process may create a strong adhesion between the rotating shaft 23 and the metallic case 22, the raised ring structure of the hub and the embossed recess of the rotating shaft that are used in the conventional impeller may be omitted. Moreover, since the thickness of the top wall 221 of the metallic case 22 is too small (e.g. 0.1-2.0 mm), it is advantageous to design a slim-type fan by using the impeller 2. As the thickness of the metallic case 22 is decreased, the space under the metallic case 22 for accommodating the stator of the fan will be increased. In this situation, the coil turn may be increased in order to enhance the operating performance of the fan.

For manufacturing the impeller 2, the rotating shaft 23 and the metallic case 22 are firstly jointed together by the laser welding process, then the combination of the rotating shaft 23 and the metallic case 22 is placed within a plastic injection mold (not shown), and finally the hub 20 and the blades 21 of the impeller 2 are produced by the plastic injection molding process. In accordance with the present invention, no raised ring structure is formed in the top wall 221 of the metallic case 22, and no embossed recess is formed in the rotating shaft 23. In addition, the thickness of the top wall 221 of the metallic case 22 is ranged from 0.1 to 2.0 mm.

Since the rotating shaft 23 and the metallic case 22 are firstly jointed together by the laser welding process and then the hub 20 and the blades 21 of the impeller 2 are produced by the plastic injection molding process, the mold for the impeller 2 of the present invention is simpler than the mold used in the conventional impeller. In addition, the adhesion between the rotating shaft and the hub is not necessarily taken into consideration, the possibility of abrading the rotating is minimized, the thicknesses of the hub and the metallic case are not needed to be greater than the minimum thickness, and the hub and the metallic case are not shrunk or deformed after the plastic injection molding process is done. Moreover, since no embossed recess is formed in the rotating shaft, the process of producing the rotating shaft is vey simple. Since the welding points for performing the laser welding process are symmetrically arranged or arranged in a ring-shaped profile, the range of the torsion force of the rotating shaft will be widened.

The laser welding process may be performed to weld various metals. That is, the metallic case 22 and the rotating shaft 23 of the impeller 2 may be made of any metallic material or alloy, for example gold, silver, copper, iron, titanium, nickel, tin, aluminum, chromium, or the alloy thereof. In addition, the metallic case 22 and the rotating shaft 23 may be made of identical material or different materials.

Please refer to FIG. 2C. The outer surface of the metallic case 22 may has a level difference. That is, the metallic case 22 further comprises a sub-top wall 223, whose horizontal level is slightly lower than the top wall 221. When the metallic case 22 is sheathed by the hub 20, the sub-top wall 223 of the metallic case 22 is sheltered by the hub 20, but the top wall 221 of the metallic case 22 and the hub 20 are substantially at the same level. As a consequence, the overall height of the fan is not considerably increased.

Figure 3:
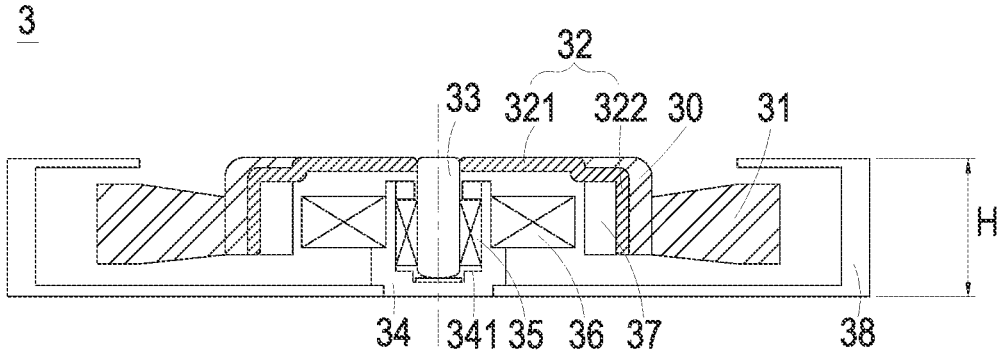
FIG. 3 is a schematic cross-sectional view illustrating a fan according to an embodiment of the present invention.

FIG. 3 is a schematic cross-sectional view illustrating a fan having the impeller of FIGS. 2A-2C according to an embodiment of the present invention. As shown in FIG. 3, the fan 3 comprises a hub 30, plural blades 31, a metallic case 32, a rotating shaft 33, a motor base 34, a bearing 35, a stator 36, a magnetic element 37 and a fan frame 38. The metallic case 32 is sheathed by the hub 30. The blades 31 are disposed around the outer periphery of the hub 30 for driving axial airflow or radial airflow. In addition, the blades 31 and the hub 30 are integrally formed by a plastic injection molding process. The metallic case 32 is an integral part, and comprises a top wall 321 and a sidewall 322. The sidewall 322 is axially or downwardly extended from the outer periphery of the top wall 321. The top wall 321 has a central opening 321*a* in its central portion. The rotating shaft 33 is made of metallic material, and protruded from the center portion of the top wall 321. The rotating shaft 33 is inserted into the central opening 321*a* of the top wall 321, and the rotating shaft 33 is combined within the central opening 321*a* of the top wall 321 by a laser welding process. A top surface 330 of the rotating shaft 33 and a top surface 3210 of the top wall 321 of the metallic case 32 are coplanar.

A bearing stand 341 is formed in a center portion of the motor base 34. The bearing 35 is accommodated within the bearing stand 341. The rotating shaft 33 is penetrated through the bearing 35. The stator 36 is disposed around the outer periphery of the bearing stand 341. The magnetic element 37 is disposed on the inner wall of the metallic case 32 and aligned with the stator 36. The fan frame 38 is disposed at the outer portion of the fan 3 and surrounds the hub 30, the blades 31, the metallic case 32, the rotating shaft 33, the motor base 34, the bearing 35, the stator 36 and the magnetic element 37. Since the rotating shaft 33 and the metallic case 32 are jointed together by the laser welding process, the thicknesses of the metallic case 32 is not needed to be greater than the minimum thickness. In this situation, the overall thickness H of the fan 3 may be smaller than 10 mm. Preferably, the overall thickness H of the fan 3 is smaller than 7 mm. Consequently, this slim-type fan 3 is achievable and may be used in an ultra-thin notebook computer or other slim-type electronic device.

The present invention further provides a method of manufacturing a fan. Firstly, the rotating shaft 33 and the metallic case 32 are firstly jointed together by a laser welding process. Then, the combination of the rotating shaft 33 and the metallic case 32 is placed within a plastic injection mold (not shown). Afterward, the hub 30 and the blades 31 of an impeller are produced by the plastic injection molding process. In accordance with the present invention, no raised ring structure is formed in the top wall 321 of the metallic case 32, and no embossed recess is formed in the rotating shaft 33. In addition, the thickness of the top wall 321 of the metallic case 32 is ranged from 0.1 to 2.0 mm. Then, a motor base 34 is provided, wherein the motor base 34 has a bearing stand 341 in a center portion thereof. Afterward, a bearing 35 is accommodated within the bearing stand 341, and a stator 36 is disposed around the outer periphery of the bearing stand 341. Then, a magnetic element 37 is disposed on the inner wall of the metallic case 32. Thereafter, the rotating shaft 33 is penetrated through the bearing 35 such that the magnetic element 37 is aligned with the stator 36. Then, a fan frame 38 is disposed at the outer portion of the above resulting structure. Meanwhile, the fan 3 is assembled.

Figure 4:
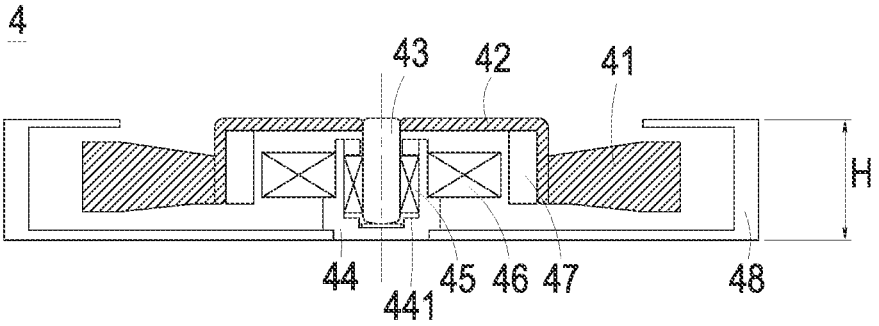
FIG. 4 is a schematic cross-sectional view illustrating a fan according to another embodiment of the present invention.

FIG. 4 is a schematic cross-sectional view illustrating a fan according to another embodiment of the present invention. As shown in FIG. 4, the fan 4 comprises plural blades 41, a metallic case 42, a rotating shaft 43, a motor base 44, a bearing stand 441, a bearing 45, a stator 46, a magnetic element 47 and a fan frame 48. In this embodiment, the blades 41 are made of metallic material rather than plastic material. As a consequence, the blades 41 are integrally formed with the metallic case 42, and blades 41 are disposed around the outer periphery of the metallic case 42. In addition, no hub is included in the fan 4. The configurations of the other components of the fan 4 are similar to those of the fan 3 as shown in FIG. 3, and are not redundantly described herein. Since the rotating shaft 43 and the metallic case 42 are jointed together by the laser welding process, the thicknesses of the metallic case 42 is not needed to be greater than the minimum thickness. In this situation, the overall thickness H of the fan 4 may be smaller than 10 mm. Preferably, the overall thickness H of the fan 4 is smaller than 7 mm. Consequently, this slim-type fan 4 is achievable and may be used in an ultra-thin notebook computer or other slim-type electronic device.

From the above description, the fan impeller of the present invention comprises a hub, plural blades, a metallic case and a rotating shaft. The rotating shaft is inserted into the central opening of the top wall of the metallic case. The rotating shaft and the metallic case are directly jointed together by a laser welding process. In addition, no raised ring structure is formed in the top wall of the metallic case. In accordance with the present invention, the top wall of the metallic case has a thickness of 0.1-2.0 mm. The problem of abrading the rotating shaft will be eliminated. In addition, the mold for the impeller is simplified. Since no embossed recess is formed in the rotating shaft, the range of the torsion force of the rotating shaft will be widened. Moreover, since the overall thickness of the fan may be smaller than 10 mm, the slim-type fan of the present invention may be used in an ultra-thin notebook computer or other slim-type electronic device.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fan, comprising:

a motor base having a bearing stand in a center portion thereof;

a bearing accommodated within said bearing stand;

an impeller comprising:

a metallic case having a top wall and a sidewall extended axially from an outer periphery of said top wall, wherein said top wall has a central opening, a bottom surface, and a top surface, said top surface continuous with a curved surface that defines part of said central opening, and a depth of said central opening from said top surface to said bottom surface is equal to a thickness of said top wall;

a hub sheathed around said metallic case;

plural blades disposed around an outer periphery of said hub for driving axial airflow or radial airflow; and a rotating shaft inserted into said central opening and penetrated through said bearing stand, said rotating shaft is combined within said central opening by a laser welding process;

a stator disposed around an outer periphery of said bearing stand; and a magnetic element disposed on said metallic case and aligned with said stator, wherein said metallic case further comprises a sub-top wall at a horizontal level lower than said top wall and the bottom surface extends from said central opening to said sub-top wall.

2. The fan according to claim 1 wherein said thickness of said top wall of said metallic case is ranged from 0.1-2.0 mm.

3. The fan according to claim 1 wherein said rotating shaft is made of metal.

4. The fan according to claim 1 wherein no embossed recess is formed in said rotating shaft.

5. The fan according to claim 1 wherein said plural blades are integrally formed with said hub.

6. The fan according to claim 1 wherein said sub-top wall of said metallic case is sheltered by said hub.

7. The fan according to claim 1 wherein said fan further comprises a fan frame, which is arranged at an outer portion of said fan.

8. The fan according to claim 1 wherein an overall thickness of said fan is smaller than 10 mm.

9. A fan, comprising:

a motor base having a bearing stand in a center portion thereof;

a bearing accommodated within said bearing stand;

an impeller comprising:

a metallic case having a top wall and a sidewall extended axially from an outer periphery of said top wall, wherein said top wall has a central opening, and a depth of said central opening is equal to a thickness of said top wall;

a hub sheathed around said metallic case;

plural blades disposed around an outer periphery of said hub for driving axial airflow or radial airflow; and a rotating shaft inserted into said central opening and penetrated through said bearing stand, said rotating shaft is combined within said central opening by a laser welding process;

a stator disposed around an outer periphery of said bearing stand;

a magnetic element disposed on said metallic case and aligned with said stator; and a fan frame, which is arranged at an outer portion of said fan, wherein a top surface of the rotating shaft, a top surface of the top wall of the metallic case, a top surface of the hub, and a top surface of the fan frame are coplanar.

* * * * *